US011795835B2

(12) United States Patent
Milne

(10) Patent No.: US 11,795,835 B2
(45) Date of Patent: Oct. 24, 2023

(54) SAFETY APPARATUS FOR CONTAINING AN ENERGY RELEASE FROM A ROTOR ASSEMBLY

(71) Applicant: Siemens Energy Global GmbH & Co. KG, Bayern (DE)

(72) Inventor: Trevor Milne, Sheffield (GB)

(73) Assignee: Siemens Energy Global GmbH & Co. KG, Bayern (DE)

( * ) Notice: Subject to any disclaimer, the term of this patent is extended or adjusted under 35 U.S.C. 154(b) by 148 days.

(21) Appl. No.: 17/284,924

(22) PCT Filed: Aug. 12, 2019

(86) PCT No.: PCT/EP2019/071557
§ 371 (c)(1),
(2) Date: Apr. 13, 2021

(87) PCT Pub. No.: WO2020/088809
PCT Pub. Date: May 7, 2020

(65) Prior Publication Data

US 2021/0381392 A1 Dec. 9, 2021

(30) Foreign Application Priority Data

Oct. 30, 2018 (EP) ..... 18203334

(51) Int. Cl.
*F01D 21/04* (2006.01)
*F01D 5/06* (2006.01)
(Continued)

(52) U.S. Cl.
CPC ..... *F01D 21/045* (2013.01); *F01D 5/066* (2013.01); *F01D 25/243* (2013.01);
(Continued)

(58) Field of Classification Search
CPC . F01D 5/06; F01D 5/066; F01D 25/24; F01D 25/28; F01D 25/243; F01D 25/285;
(Continued)

(56) References Cited

U.S. PATENT DOCUMENTS

2001/0017090 A1 8/2001 Zehnder
2006/0013693 A1 1/2006 Meacham et al.
(Continued)

FOREIGN PATENT DOCUMENTS

CN 105308265 A 2/2016
EP 1114977 A1 7/2001
(Continued)

OTHER PUBLICATIONS

International search report and written opinion dated Jan. 3, 2020, for corresponding PCT/EP2019/071557.

*Primary Examiner* — Christopher Verdier
*Assistant Examiner* — Ryan C Clark
(74) *Attorney, Agent, or Firm* — WOLTER VAN DYKE DAVIS, PLLC

(57) ABSTRACT

A safety apparatus for containing an energy release from a rotor sub-assembly, the safety apparatus includes a plurality of containment members. The containment member has an elongate region defining a longitudinal axis; and at least two arms projecting away from the longitudinal axis of the elongate region; and at least one connecting member connected to at least two of the plurality of containment members. In use the at least one connecting member is configured to connect the safety apparatus to the sub-assembly and the plurality of containment members are configured to withstand an energy release from the sub-assembly.

15 Claims, 8 Drawing Sheets

(51) Int. Cl.
*F01D 25/24* (2006.01)
*F01D 25/28* (2006.01)
*F01D 25/16* (2006.01)

(52) U.S. Cl.
CPC ..... *F01D 25/285* (2013.01); *F01D 25/162* (2013.01); *F05D 2230/10* (2013.01); *F05D 2230/64* (2013.01); *F05D 2240/50* (2013.01); *F05D 2260/31* (2013.01)

(58) Field of Classification Search
CPC .... F01D 21/045; B23B 25/04; F16C 2220/60; F16C 2220/62; F05D 2240/14; F05D 2230/10; B23P 2700/13; Y10T 29/4986; Y10T 29/4999; Y10T 29/4932
USPC ..... 415/9
See application file for complete search history.

(56) References Cited

U.S. PATENT DOCUMENTS

| | | | | |
|---|---|---|---|---|
| 2010/0162544 | A1* | 7/2010 | Sassatelli | F01D 25/285 29/889.1 |
| 2015/0251768 | A1 | 9/2015 | Woolley | |
| 2016/0102556 | A1 | 4/2016 | Twell | |
| 2016/0258491 | A1 | 9/2016 | Harrison | |
| 2021/0355829 | A1* | 11/2021 | Milne | F01D 21/04 |
| 2021/0381393 | A1* | 12/2021 | Milne | F01D 5/066 |

FOREIGN PATENT DOCUMENTS

| | | | |
|---|---|---|---|
| EP | 1983161 | A1 | 10/2008 |
| EP | 2672061 | A1 | 12/2013 |
| EP | 3168588 | A1 | 5/2017 |

* cited by examiner

SAFETY APPARATUS FOR CONTAINING AN ENERGY RELEASE FROM A ROTOR ASSEMBLY

CROSS REFERENCE TO RELATED APPLICATIONS

This application is the US National Stage of International Application No. PCT/EP2019/071557 filed 12 Aug. 2019, and claims the benefit thereof. The International Application claims the benefit of European Application No. EP18203334 filed 30 Oct. 2018. All of the applications are incorporated by reference herein in their entirety.

FIELD OF INVENTION

The present disclosure relates to a safety apparatus for containing loads applied to shaft arrangements particularly, but not exclusively for turbo engines and turbo-machines having a compressor, a turbine or a power turbine mounted to an axial shaft.

BACKGROUND

In gas turbine engines, compressors and turbines typically have axially arranged sets of rotors, each comprising an array of blades mounted to rotor discs. The respective sets of rotors are located between end shafts on a tension stud that extends through all or part of the set of rotors. In operation, the rotation of the rotors causes high separation forces to develop in the rotors. To counter these separation loads, a compression load is applied to the shaft and the rotors prior to use to offset the separation loads that develop in operation. To develop the compression load in the shaft and rotors, the tension stud is stretched during assembly to develop a tension within the tension stud. The tension stud is then held in its stretched form by a load retainer that engages with the shaft. The tension stud will react against the shaft via the load retainer to apply the compression load to the shaft.

Due to the high separation loads encountered in operation, there are high compression loads applied to the shaft, which may cause deformation of one or more parts of the shaft, such as the journal. A deformed journal diameter, i.e. non-cylindrical, compromises the operation of the bearing it is paired with in operation.

One solution to matching the geometry of the journal to the bearing is to machine the journal once the whole rotor assembly has been constructed. However, this is a complicated process and requires whole rotor assembly to be fitted in a machine.

EP 3 168 588 A1 there is disclosed a protective assembly engaging in case of tensile failure comprising an elongate tubular member, and a catcher rod. The tubular member has a first end portion and an opposite second end portion, and a fuse portion is positioned between the first end portion and the second end portion. A cross-sectional area of the tubular member is reduced at the fuse portion. The catcher rod has a first end portion and an opposite second end portion, with the catcher rod being accommodated concentrically within the tubular member. The second end portion of the catcher rod is secured to the second end portion of the tubular member. The first end portion of the tubular member is provided with a first divergent conical portion, and the first end portion of the catcher rod is provided with a second divergent conical portion. In the event of breakage of the tubular member, the second divergent conical portion impinges against the first divergent conical portion to limit the axial movement of the tubular member.

Therefore, there is a need to provide a safe method for providing a shaft with a journal that matches the geometry of a bearing.

SUMMARY

According to the present disclosure there is provided an apparatus and method as set forth in the appended claims. Other features of the invention will be apparent from the dependent claims, and the description which follows.

According to a first aspect of the invention, there is provided a safety apparatus for containing an energy release from a rotor sub-assembly advantageously having a tension stud. The safety apparatus comprises a plurality of containment members. Each containment member comprises: an elongate region defining a longitudinal axis; and at least two arms projecting away from the longitudinal axis of the elongate region. The safety apparatus also includes at least one connecting member connected to at least two of the plurality of containment members. In use the at least one connecting member is configured to connect the safety apparatus to the sub-assembly and the plurality of containment members are configured to withstand an energy release from the sub-assembly in the event of a failure of one or more components and/or connections of the sub-assembly. Hence there is provided a safety apparatus that enables a sub-assembly of the rotor assembly to be safely stored and transported for machining after a load has been applied to the sub-assembly. The safety apparatus is suitable for containing energy released from a sub-assembly in the event of a failure of one or more components and/or connections of the sub assembly. The provision of the safety apparatus significantly reduces the risk to nearby workers and equipment as any energy released by a failure of one or more components will be restrained by the safety apparatus. Further, the provision of safety apparatus enables the sub-assembly to be safely transported for machining.

In one example, the plurality of containment members comprises a first containment member and a second containment member having a central axis therebetween, wherein the at least two arms of the first containment member and the at least two arms of the second containment member project towards the central axis. The provision of a first containment member and a second containment member with arms projection towards each other means that an energy release will be contained by multiple arms.

In one example, there is provided an assembly comprising the safety apparatus and a sub-assembly. The sub-assembly includes a shaft of a rotor assembly, the shaft comprising a journal, a tension stud extending through the shaft, an adapter engaged with a first end of the shaft and a load retainer configured to engage with a second end of the shaft and receive the tension stud. In use, the load retainer is configured to move relative to the tension stud and transfer a load from the tension stud to the shaft.

In one example, the adapter is shaped such that a first end of the adapter is configured to engage with a first shaft having a first profile and a second end of the adapter is configured to engage with a second shaft having a second profile, different to the first profile. As such, the adapter may be used with shafts of different shapes and sizes.

The sub-assembly may also include a compression body engaged with the second end of the shaft, a tool head engaged with the tension stud and an actuator located between the compression body and the tool head for applying a load to the tool head and the compression body. The at least one connecting member may include a first connecting member connected to the compression body and a second connecting member connected to the adapter. The provision of a compression body, actuator and tool head provides a mechanism to apply a tension load to the tension stud and a corresponding compression load to the shaft, which is required to counter separation forces that develop in operation.

The first connecting member may be connected to the compression body via a first quick release pin and the second connecting member may be connected to the adapter via a second quick release pin. The use of quick release pins means that the safety apparatus may be quickly and securely connected to the sub-assembly.

In one example, the compression body includes a protective covering configured to cover at least part of the shaft. There may be sensitive components within the assembly that may be easily damaged or sensitive to knocks. By providing the protective covering, the compression body may fulfil the dual role of transferring load from the actuator to the shaft and also protecting some components of the assembly from damage.

The sub-assembly may also include a transport plate configured to receive the tension stud, wherein the load retainer is located between the transport plate and the shaft. The at least one connecting member may include a first connecting member connected to the transport plate and a second connecting member connected to the adapter. The provision of the transport plate provides a fixture point for a connecting member and so enables the sub-assembly and safety frame to be transported together in a state that is ready for machining.

In one example, the sub assembly includes a first machine centre configured to engage with the adapter; and a second machine centre configured to engage with the transport plate. The first and second machine centres enables the assembly to be quickly placed in the machine ready for machining.

The tool head may include a removable insert, the removable insert including a male thread for engaging with a co-operative female thread of the tool head; and a female thread for engaging with a co-operative male thread of the tension stud. The removable insert may be made of a higher grade material compared with the rest of the tool head.

The assembly may include a measurement apparatus configured to measure the elongation of the tension stud. The measurement apparatus may be used to determine that the tension stud has extended by a pre-determined amount, equivalent to a pre-determined tension load being developed in the tension stud and hence, a pre-determined compression load being applied to the shaft.

According to another aspect of the invention, there is provided a method of shaping a journal of a shaft of a rotor sub-assembly, the method includes applying a pre-determined compression load to the shaft, wherein the pre-determined compression load results in a deformation of the journal to produce a loaded journal with a substantially concave profile and shaping the loaded journal to produce a substantially cylindrical loaded journal, wherein when the pre-determined compression load is removed, the journal has a substantially convex profile. Applying a pre-determined compression load to the shaft effectively recreates the compression load that the shaft will be subject to in operation, which in turn recreates the deformation or barrelling of the journal. In the loaded state, the shaft is then shaped or machined back to a cylindrical shape, i.e. the effect of the barrelling is removed. When the pre-determined load is removed from the shaft, then the journal will have a substantially concave profile, but when this load is re-applied, for example when the shaft is part of the rotor assembly, then the journal will deform back to the cylindrical shape. Therefore, the effects of a misalignment between the journal and a bearing on which the journal is supported due to barrelling is removed and a bearing with a cylindrical inner profile may be used.

In one example, the step of applying the a pre-determined compression load to the shaft includes engaging an adapter with a first end of the shaft, engaging a compression body with a second end of the shaft, engaging a tool head with a tension stud extending through the shaft, providing an actuator between the compression body and the tool head, actuating the actuator to provide a load to the compression body and the tool head to cause the tension stud to extend and the pre-determined compression load to be applied to the shaft; and engaging a load retainer with the second end of the shaft to retain the load in the shaft.

The method may also include the step of connecting the safety apparatus to the compression body and/or the adapter prior to actuating the actuator. The provision of the safety apparatus means that the load can be applied to the tension stud and shaft in safety, and there is reduced risk of a nearby operator becoming injured due to a failure of one or more components as the release of energy will be contained within the safety apparatus.

The step of shaping the loaded journal may include removing the tool head, the actuator and the compression body, providing a transport plate that receives the tension stud, wherein the load retainer is located between the transport plate and the shaft, connecting the safety apparatus to the transport plate and/or the adapter, engaging a first machine centre with the adapter, engaging a second machine centre with the transport plate, positioning the first machine centre and the second machine centre between centres of a machine, removing the safety apparatus and machining the journal of the shaft.

BRIEF DESCRIPTION OF THE DRAWINGS

Examples of the present disclosure will now be described with reference to the accompanying drawings, in which.

DETAILED DESCRIPTION

Figure 1:
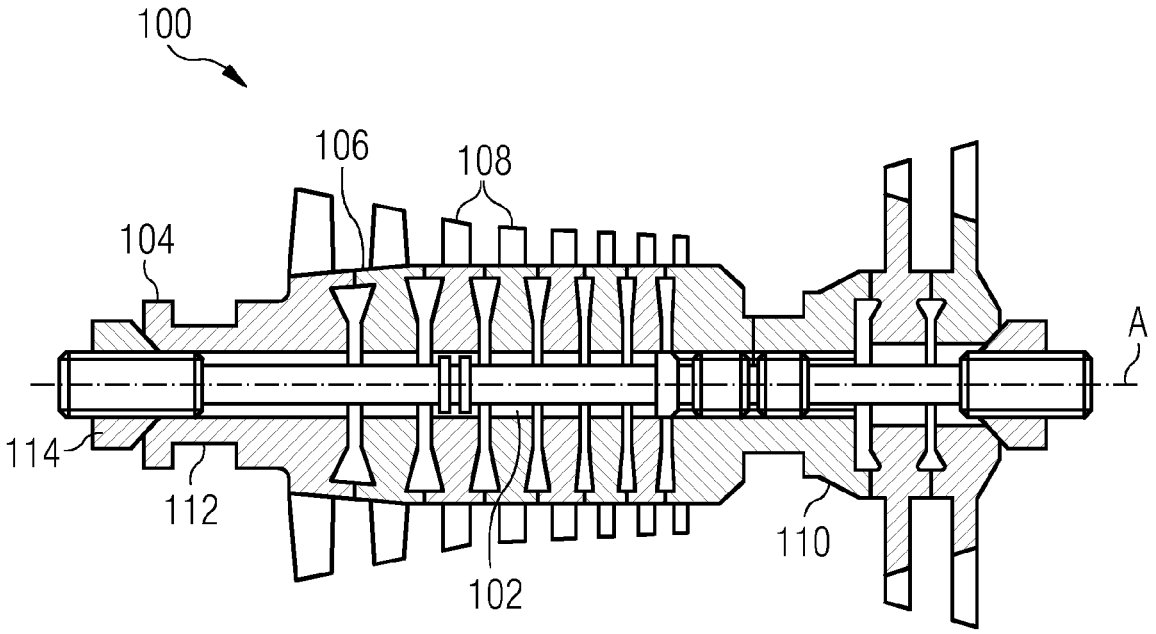
FIG. 1 shows a schematic of an example of a rotor assembly.

FIG. 1 shows an example of a rotor assembly 100 of a gas turbine engine. A tension stud or tension bolt 102 is provided in the axial centre of the rotor assembly 100, along an axis A of rotation of the rotor assembly 100. In one example, the gas turbine engine is an SGT-100, SGT-300 or an SGT-400.

In operation, the rotor assembly 100 is arranged to rotate about the axis A of rotation. All rotor parts shown in the figures may be substantially rotationally symmetric about the axis A of rotation. Stator parts are not shown in the figures and elements that interlock the rotors may not be shown in the figures.

One or more shaft elements 104, 110, such as an inlet shaft 104 and exit shaft 110, and compressor discs 106 are provided around the tension stud 102 and configured to rotate about the axis A of rotation. The shaft elements 104, 110 and the compressor discs 106 may be interlocked axially between axially adjacent rotating parts. For example, the inlet shaft 104 and the compressor discs 106 may comprise corresponding teeth that mesh together to interlock the inlet shaft element 104 and the compressor disc 106. A plurality of rotor blades 108 are held in place by the compressor discs 106. In one example, a rotor blade comprises a "t-shaped" root that is held in place between correspondingly shaped sections of the compressor discs 106. In other examples, the rotor blades 108 may extend from the compressor discs 106 themselves in the form of a blisk.

As such, the tension stud 102, the inlet shaft 104, the compressor discs 106 and the rotor blades 108 may rotate together at the same speed about the axis A of the rotor. The tension stud 102 may be rotated into a threaded engagement into a threaded bore of an exit shaft 110 or alternatively be received in a retention nut (not shown), which engages with the exit shaft 110.

The inlet shaft 104 includes one or more journals 112 that are configured to engage with one or more journal bearings (not shown) to enable the rotor assembly 100 to rotate about the Axis A.

In one example, the bearing may be a tilt-pad bearing. The tilt-pad bearing includes a plurality of white metal pads matched to the geometry of the journal 112. In use, the pads may pivot within the bearing, which is flooded with oil. When the shaft 104 is rotated at to working speed, a film of oil is present between the inlet shaft 104 and the pads so there is no metal to metal contact between the journal 112 and the white metal pads of the bearing. However, the use of bearings such as tilt-pad bearings is highly reliant on the geometry being matched between the journal and the bearing. If this geometry is not aligned then there may be metal-to-metal contact, which causes friction, wear and energy loss within the rotor assemble 100.

In operation, as the rotor assembly 100 rotates about the rotation axis A, high separation forces develop in the discs 106 and rotor blades 108. In order to counteract these separation loads, the inlet shaft 104 and exit shaft 110 are pre-loaded with a compression load. As such, the discs 106 and rotor blades 108 will not separate in operation.

In order to apply the compressive loads to the inlet shaft 104, the tension stud 102 is subject to a tension load. A load retainer 114 is attached to one end of the tension stud 102 and engages with one end of the inlet shaft 104. As the load retainer 114 is supported by the inlet shaft 104, the tension in the tension stud 102 causes a compression load to develop in the inlet shaft 104.

Figure 2:
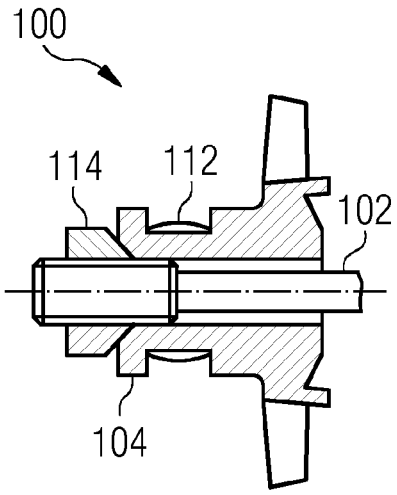
FIG. 2 shows an example of a schematic of a part of a rotor assembly.

FIG. 2 shows an example of a schematic of a part of a rotor assembly 100. In the example shown in FIG. 2, the tension stud 102 has been subjected to a tension load and is held in tension due to the presence of the load retainer 114, which engages with the inlet shaft 104 causing a compression load to develop in the inlet shaft 104.

Due to the compression load in the inlet shaft 104, the inlet shaft 104 may deform. For example, the journal 112 may deform by barrelling such that part of the journal bulges outwards, as shown in FIG. 2. Barrelling of the journal 112 is undesirable as it may compromise the function of the associated bearings employed, especially tilt pad type bearings in which the accuracy of the geometry between the bearing and the journal 112 is essential. As such, to minimise the effect of the deformation of the journal 112 when subject to a compression load, the journal 112 of the inlet shaft 104 is machine precision finished prior to final assembly within the rotor assembly 100.

In order to simulate the deformation of the journal 112 when subject to the compressive load as part of the final rotor assembly 100, the inlet shaft 104 is subject to a temporary compression load designed to simulate the compression load that the inlet shaft 104 will be subject to when part of the final rotor assembly 100.

Figure 3:
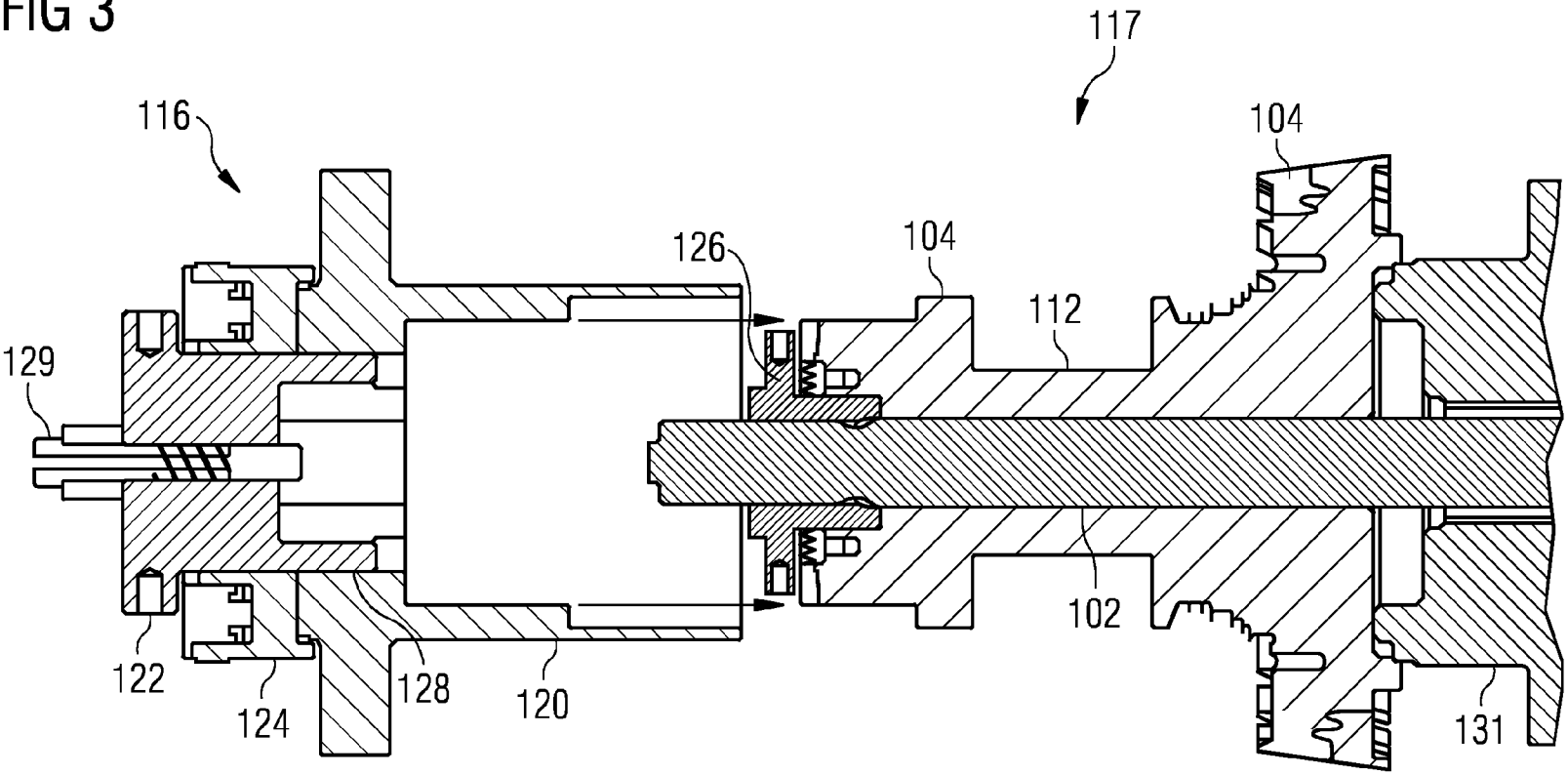
FIG. 3 shows an example of a first sub-assembly of a rotor assembly.

FIG. 3 shows an example of a first sub-assembly 117 comprising a tool apparatus 116 for applying a load an inlet shaft 104 and tension stud 102.

The tool apparatus 116 includes a compression body 120 configured to engage with the inlet shaft 104 of the rotor assembly 100. The compression body 120 has a profile at one end that corresponds with a shape of one end of the inlet shaft 104 to ensure a positive engagement between the compression body 120 and the inlet shaft 104. The compression body 120 may be substantially cylindrical with an axial hole therethrough such that one end of the tension stud 102 may be received in the compression body 120. The compression body 120 may have substantially cylindrical shaped walls which may include an aperture to enable access to the inside of the compression body 120.

The tool apparatus 116 includes a tool head 122 that is configured to connect to the tension stud 102. In one example, the tool head 122 is a nut that may engage with the tension stud 102. In another example, the tool head 122 may be substantially cylindrical and include a first region having a first diameter and a second region having a second, smaller diameter, creating a lip to enable an actuator 124 to engage with the tool head 122 and exert a load thereon. The compression body 120 may be sized to receive at least part of the tool head 122 within the axial hole of the compression body 120.

In FIG. 3, the tool head 122 is disengaged from the tension stud 102. In one example, the tool head 122 includes a female threaded connection which is configured to engage with a corresponding male threaded connection on the tension stud 102.

Within the tool apparatus 116 there are critical cyclic life components that require monitoring during their repeated use, the female thread of the tool head 122 that engages with the tension stud 102 is one such component. To minimise the cost of replacing the entire tool head 122 once the internal female thread of the tool head 122 has worn to an undesirable state, the tool head 122 may include a removable insert 128 such that the tool head 122 is connected to the tension stud 102 via the removable insert 128. In one example, the removable insert 128 includes a male thread for engaging with a co-operative female thread within the tool head 122 and a female thread for engaging with a co-operative male thread of the tension stud 102. The removable insert 128 may be economically made from higher grade material compared with the remainder of the tool head 122. Further, the removable insert 128 may be changed-out with a spare or replacement removable insert 128 whilst the original is away for inspection. This enables continued use of tool apparatus 116 whilst the original removable insert 128 is being inspected. Further, the removable insert 128 may comprise a non-shouldered outer thread, which enables its reversal. As such, the usable life of the removable insert is extended because the redundant thread is utilised.

The tool apparatus 116 includes an actuator 124 configured to apply a load to the tool head 122 and the compression body 120. In the example shown in FIG. 3, the actuator 124 is engaged with the compression body 120 and the tool head 122. In one example, the actuator 124 has an axial hole therethrough for receiving at least part of the tool head 122.

The tool apparatus 116 may include a measurement apparatus 129 for measuring the stretch or elongation of the tension stud 102. The measurement apparatus 129 will be explained in more detail below.

The rotor assembly 100 includes a load retainer 126 and a connector (not shown), which will be explained in more detail below.

The tool apparatus 116 may also include an adapter body 131 configured to engage with the inlet shaft 104. In one example, the adapter body 131 is shaped to positively engage with a first end of the inlet shaft to ensure a positive engagement between the adapter body 131 and the inlet shaft 104.

In one example, the adapter body 131 is reversible such that a second side of the adapter body 131 is configured to engage with an inlet shaft 104 having a different diameter.

Figure 4:
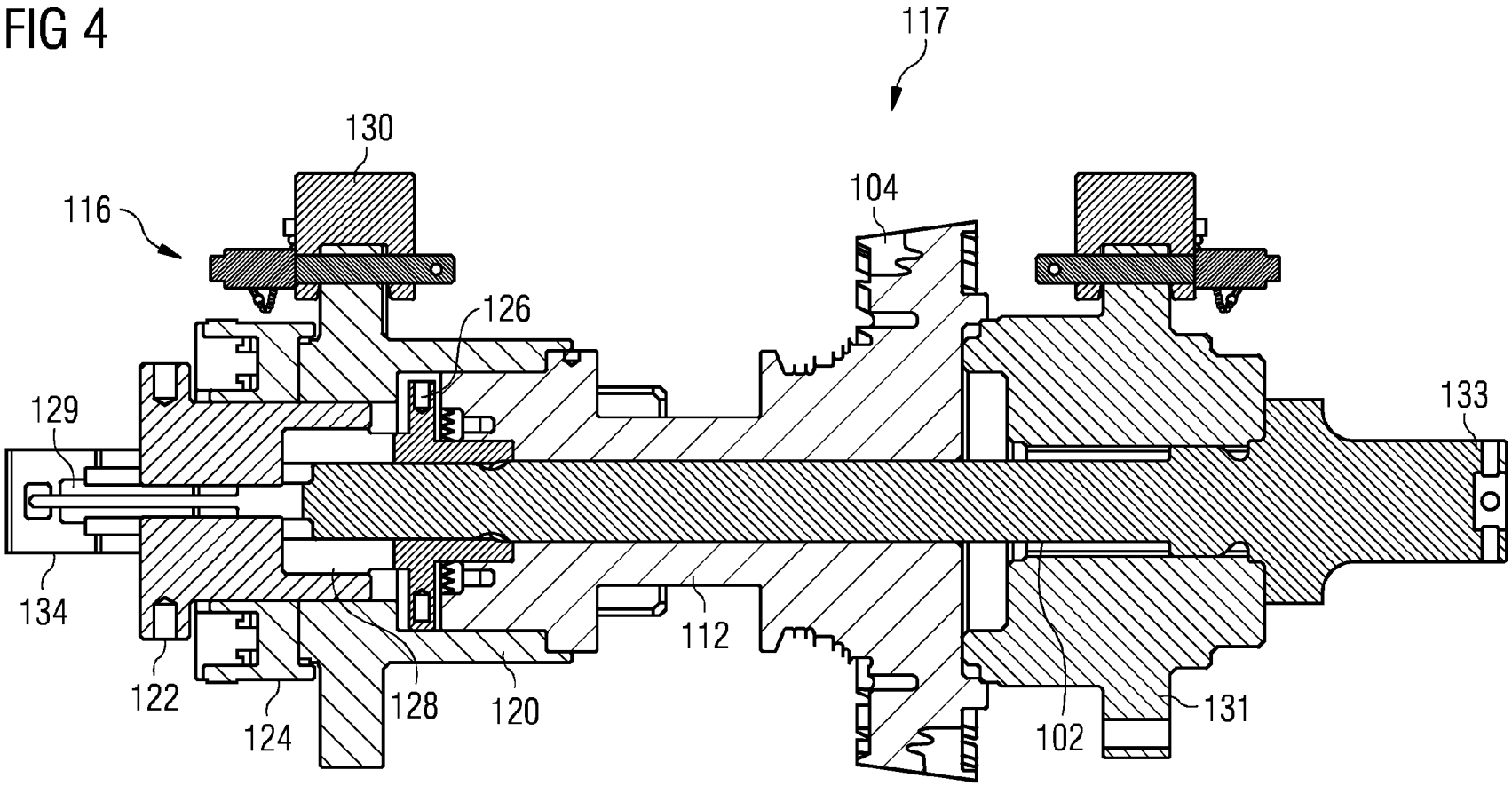
FIG. 4 shows an example of safety apparatus applied to a first sub-assembly of a rotor assembly.

FIG. 4 shows a cross section of a schematic of a sub-assembly 117 of the rotor assembly 100 along with a part of a safety apparatus 130. In the example shown in FIG. 4, the tool head 122 is engaged with the tension stud 102 via the replaceable tool insert 128. In one example, a temporary tension stud is connected to the tension stud 102 and the tool apparatus 116 may be connected to the tension stud 102 via the temporary tension stud.

In the example shown in FIG. 4, the tool head 122 is received in the through hole in the compression body 120 and the removable insert 128 is engaged with the tension stud 102. In the arrangement shown in FIG. 4, the actuator 124 is engaged with both the tool head 122 and the compression body 120. In the example shown in FIG. 4, a safety apparatus 130 or safety frame is partly shown connected to the sub-assembly 117. The safety apparatus 130 is shown in more detail in FIGS. 5 and 6.

In FIG. 4, a first machine centre 133 is located at an end of the tension stud 102 to enable an engagement between the machine centre 133 and a machine, such as a lathe. The first machine centre 133 may be configured to engage with the adapter 131. In one example, the first machine centre 133 is adjustable via one or more adjustment screws which enable an operator to achieve concentricity limits throughout the shafts manufacturing processes. In this example, a separate lose female centre is held by four adjusting screws. The female centre is compatible with standard male 'dead centres' and 'live centres' of the machine used to produce the final journal 112. The pre-existing diametric features of the shaft 104 may be used to reference the concentricity adjustments.

In operation, the actuator 124 is configured to expand to push against the tool head 122 and the compression body 120 and exert a load on the tool head 122 and the compression body 120. As the compression body 120 is engaged with the inlet shaft 104 of the rotor assembly 100 then the load applied to the compression body 120 will be reacted by the inlet shaft 104 and the inlet shaft 104 will also be subject to compression.

In one example, the actuator 124 is a hydraulic load cell to accurately apply a pre-determined load to the tension stud 102. In other examples, the actuator 124 may be a pneumatic load cell, a torqued threaded arrangement or an electric solenoid.

Due to the connection between the tool head 122 and the tension stud 102, the load applied to the tool head 122 results in an extension of the tension stud 102 and a tension load to develop in the tension stud 102.

The load applied to the tension stud 102 is pre-determined to match the 'steady state' separation loads experienced in operation of the rotor assembly 100. In one example, to determine the tension load applied to the tension stud 102, a change in length or extension of the tension stud 102 is measured by a measurement device 129. The measurement device 129 may include a sliding plunger that projects through a bore in the tool head 122 and engages with an end of the tension stud 102 or temporary tension stud. The measurement device 129 may have an exposed end that projects from the tool head 122 and is connected to a containment member 132. In one example, the measurement device 129 includes a spring to bias the plunger against the tension stud 102 or the temporary tension stud. The exposed end of the measurement device 129 may be fixed such that the elongation or extension of the tension stud 102 may be measured due to the corresponding reduction in length of the measurement device 129.

Due to the stress-strain relationship, a pre-determined tension load can be provided to the tension stud 102 by stretching the tension stud 102 by a predetermined amount.

Once the tension stud 102 has been extended by a pre-determined amount, corresponding to a pre-determined tension load being developed in the tension stud 102, a load retainer 126 is moved to engage with the inlet shaft 104. The load retainer 126 is moved relative to the tension stud 102 to engage with the inlet shaft 104. In one example, a connector (not shown), which may be in the form of a spinner, is connected with the load retainer 126 to enable an operator to move the load retainer 126 relative to the tension stud 102, without the need for an operator to have direct access to the load retainer 126. In one example, the load retainer 126 comprises a threaded nut configured to receive a corresponding thread on the tension stud 102.

In order to access the connector, the wall of the compression body 120 may include an aperture to enable access to the inside of the compression body 120.

Following the engagement of the load retainer 126 with the inlet shaft 104, the actuator 124 may be unloaded. During unloading, the load path between the tension stud 102 and the inlet shaft 104 is changed from passing through the compression body 120 to passing through the load retainer 126. In other words, the compression body 120 becomes unloaded as the actuator 124 is unloaded and the load retainer 126 becomes loaded as the actuator 124 is unloaded.

Following the loading of the actuator 124 and engagement of the load retainer 126 with the input shaft 104, the inlet shaft 104 will be subject to a compression load, matching the compression that the inlet shaft 104 will be subject to in the rotor assembly 100. As such, the journal 112 of the inlet shaft 104 will deform or barrel such that part of the journal 112 will bulge.

In operation, depending on the size of the rotor assembly 100, the rotor assembly 100 may be subject to separation loads of approximately 50 kN. In other examples, the separation loads may be more than 250 kN, more advantageously more than 500 kN, more advantageously more than 750 kN and more advantageously more than 1000 kN. To compensate against this separation load, the tension stud 102 will be subject to a matching tension load. As such, the components of the tool apparatus 116 and rotor assembly 100 will also be subject to high loads. Whilst the components are designed to withstand the loads applied to them, in practice, there are a number of reasons why failures in the components and/or connections of the rotor assembly 100 that are subject to a load may occur.

A first source of potential failure is that one or more threads between connecting elements may fail. For example, the thread between the load retainer 126 and the tension stud 102 may fail, causing the load energy within the tension stud 102 to be released.

Alternatively, the threads between the tool head 122 and the corresponding thread of the tension stud 102 may fail during loading of the tension stud 102, which causes the load from the actuator 124 to be unrestrained at one end.

In another example, there may be a lack of engagement between the compression body 120 and the inlet shaft 104 or the actuator 124 and the tool head 122 or the compression body 120.

Further, the load applied by the actuator 124 may be too high, resulting in a failure of one or more component and/or connection between components.

In each of these examples, a release of energy occurs from the sub-assembly 117, which may cause injury to a nearby operator or damage to nearby equipment. The energy released may be between approximately 1500 J to 4000 J and so the safety apparatus 130 is designed to withstand and contain this release of energy.

With the high loads involved, there is a large amount of stored energy within the sub-assembly 117 once the load retainer 126 is in position and engaged with the inlet shaft 104. Therefore, it is essential to provide adequate safety measures to reduce the risk to nearby operators and/or equipment as a result of a release of energy from the sub-assembly 117.

Figure 5:
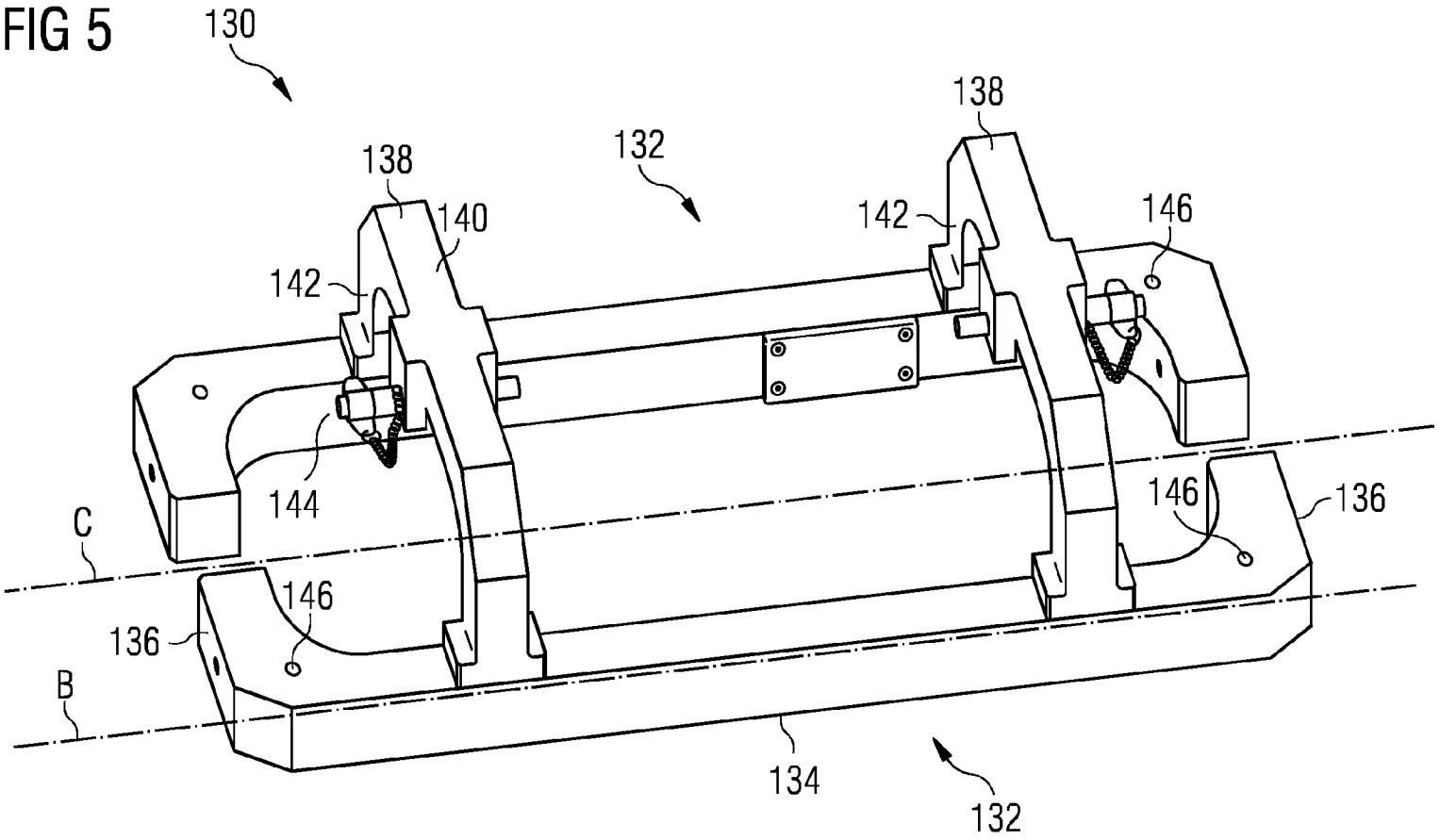
FIG. 5 shows a perspective view of a safety apparatus.

FIG. 5 shows an example of a safety apparatus or safety frame 130 for containing a release of energy from a shaft 104 of a rotor assembly 100 of the sub assembly 117. The safety apparatus 130 includes a plurality of containment members 132. In the example shown in FIG. 5, the safety apparatus 130 includes two containment members 132, however, in other examples, the safety apparatus 130 may include more than two containment members 132. The containment member 132 includes an elongate region 134 or elongate element that defines a longitudinal axis B.

In the example shown in FIG. 5, the elongate region 134 has a square or rectangular cross-section, but in other examples, the elongate region 134 may have a cross-section having any other suitable shape.

The containment member 132 includes at least two arms 136 projecting away from the longitudinal axis B of the elongate region 134. The at least two arms 136 of the containment member 132 project away from the longitudinal axis B of the elongate region 134 in the same direction. In one example, the containment member 132 includes a first arm 136 and a second arm 136. In this example, the first arm 136 may be located towards a first end of the elongate region 134 and the second arm 136 may be located towards a second end of the elongate region 134.

In the example shown in FIG. 5 in which the safety apparatus 130 includes a first containment member 132 and a second containment member 132, there is a central axis C between the containment members 132. In other words, a central axis C is defined by the mid-point between the containment members 132. In this example, the at least two arms 136 of the first containment member 132 and the at least two arms 136 of the second containment member 132 project towards the central axis C.

The safety apparatus 130 includes at least one connecting member 138 connected to at least two of the plurality of containment members 132. In one example, the at least one connecting member 138 is connected to the elongate region 134 of a first containment member 132 and the elongate region 134 of a second containment member 132.

In the example shown in FIG. 5, the safety apparatus 130 includes two connecting members 138. The connecting member 138 may have a similar shape to the containment member 132, i.e. have an elongate region 140 defining a longitudinal axis and at least two connecting arms 142 projecting away from the longitudinal axis of the elongate region 140. One of the at least two connecting arms 142 of the connecting member 138 is configured to connect to one of the containment members 132 and a different one of the at least two connecting arms 142 of the connecting member 138 is configured to connect to a different one of the containment members 132.

In use, the at least one connecting member 138 is configured to connect the safety apparatus 130 to the sub-assembly 117 at one or more connection points 144. In one example, the safety apparatus 130 includes one or more quick release pins configured to connect the safety apparatus 130 to the sub-assembly 117 at the one or more connection points 144.

The plurality of containment members 132 are configured to withstand an energy release from the sub-assembly 117 due to a failure of one or more components and/or connections of the sub-assembly 117.

In one example, the material of the safety apparatus 130 is a nickel chromium molybdenum steel, which is advantageously due to its high tensile strength and toughness.

In order to retain the loads that may be applied to the safety apparatus 130 as a result of an energy release, the containment members 132 of the safety apparatus 130 are sized so as to withstand the loads that may be released as a result of a failure of one or more components. In one example, the containment member 132 has a length of approximately 550 mm to 1100 mm and a cross-sectional area of approximately 3200 $mm^2$ to 5000 $mm^2$. Further, the arms 136 of the containment members 132 will be subject to high shear loads during an energy release and have a cross sectional area of approximately 2400 $mm^2$ to 3200 $mm^2$.

In the example shown in FIG. 5, the safety apparatus 130 also includes one or more lifting holes 146 to enable the safety apparatus 130 to be lifted together with the sub-assembly connected to the safety apparatus 130. In one example, the safety apparatus 130 includes one or more lifting holes 146 in a first direction, such as a vertical direction to enable the safety apparatus 130 and sub-assembly 117 to be lifted in the first direction. In another example, the safety apparatus 130 may also include one or more lifting holes 146 in a second direction, such as a horizontal direction to enable the safety apparatus 130 and sub-assembly 117 to be lifted in the second direction.

Figure 6:
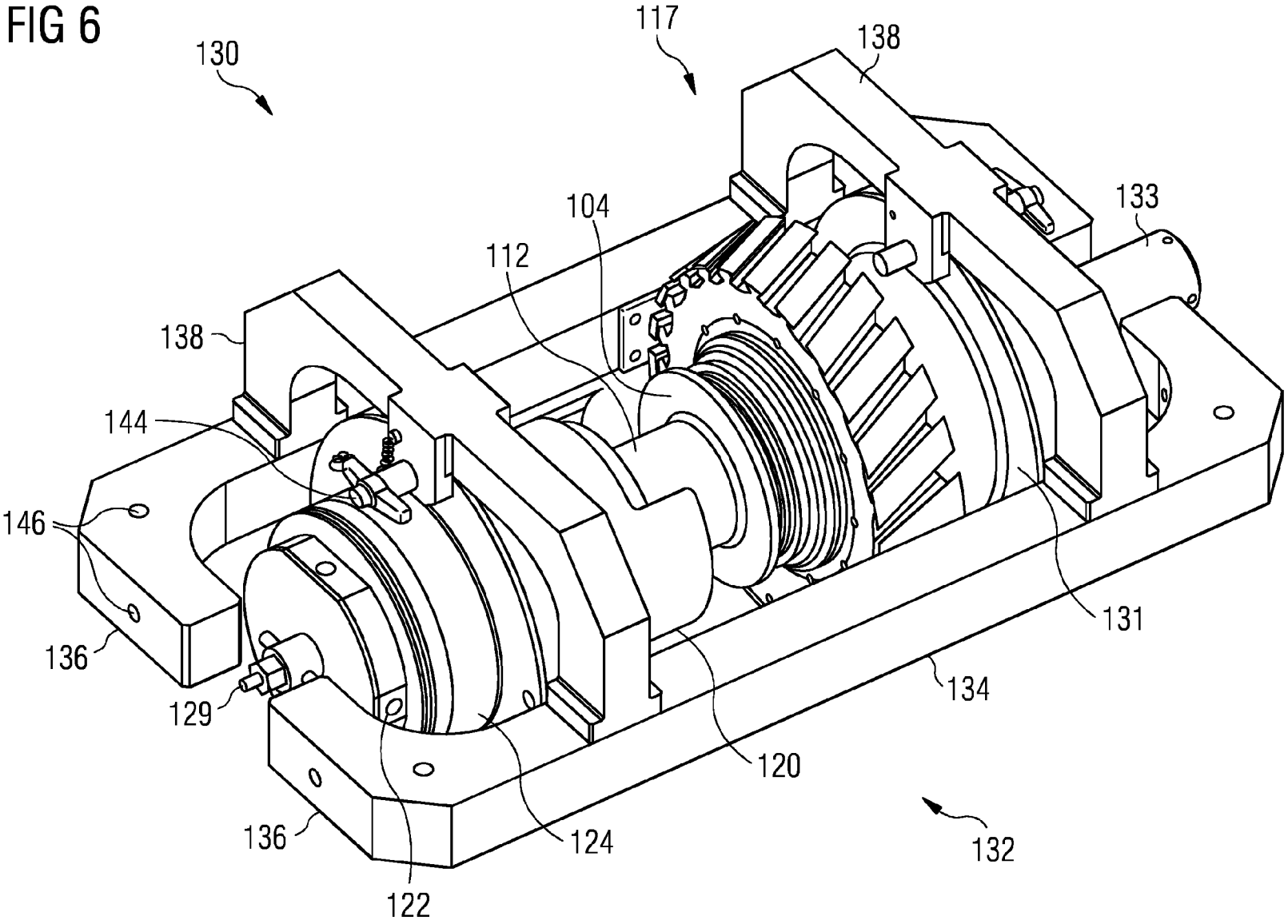
FIG. 6 shows a perspective view of a safety apparatus applied to a first sub-assembly.

FIG. 6 shows a perspective view of the safety apparatus 130 attached to a sub-assembly 117. FIG. 6 is an alternative view of FIG. 4 but shows the safety apparatus 130 in full. In the example shown in FIG. 6, the safety apparatus 130 is connected to the sub-assembly 117 via the connecting members 138. In FIG. 6, one connecting member 138 of the safety apparatus 130 is connected to the compression body 120 of the sub-assembly 117 and a second connecting member 138 is connected to the adapter 131. When the safety apparatus 130 has been applied to the sub-assembly 117, the actuator 124 may be safely actuated so as to apply a load to the tool head 122 and the compression body 120, which results in a load being applied to the tension stud 102 and inlet shaft 104 as described above. Due to the presence of the safety apparatus 130, there is a reduced risk of injury of a nearby operator.

The safety apparatus or safety frame 130 is designed to withstand the release of energy in the event of failure of any of the loaded components. It is also designed such that all lifting orientations are catered for during transportation and storage operations. In the event of a failure of one or more of the components or connections of the assembly, then the tool head 122 may quickly move away from the rotor assembly 100. With the safety apparatus 130 in place, the arms 136 will catch the tool head 122 and contain the load within the safety apparatus 130. As such, the safety apparatus 130 acts as redundancy safety mechanism, such that even in the event of a failure of one or more of the components or connections of the tool apparatus 116 or the rotor assembly 100, then the risk of injury to a user or damage to the surrounding equipment or environment is significantly reduced because the energy released by the failure will be contained within the safety apparatus 130.

It is especially essential to provide a second-tier of safety to "fool-proof" against failure scenarios such as accidental over pressure of the actuator and/or damaged or worn threads. This is achieved by the addition of the safety apparatus 130 to the tool apparatus 116. In the event of a component failure, the safety apparatus 130 is capable of containing the energy released from the tension stud 102 and/or one of the other components of the sub-assembly subject to loading.

In the example shown in FIG. 6, the compression body 120 includes a shroud portion configured to cover at least part of the inlet shaft 104. In one example, the compression body 120 is configured to engage with a major diameter of the inlet shaft 104 and the shroud portion is configured to cover components of the sub-assembly 117, such as the drive hirth teeth & spigot.

Once the load has been applied to the tension stud 102 and inlet shaft 104, the journal 112 will barrel such that at least part of the journal bulges out from the cylinder of the journal 112. To remove the effect of the barrelling, the journal 112 can be machined at this stage such that it is returned to a cylindrical shape. As the safety apparatus 130 is connected to the sub-assembly 117, the safety apparatus 130 and sub-assembly 117 may stored safely ready prior to machining.

Figure 7:
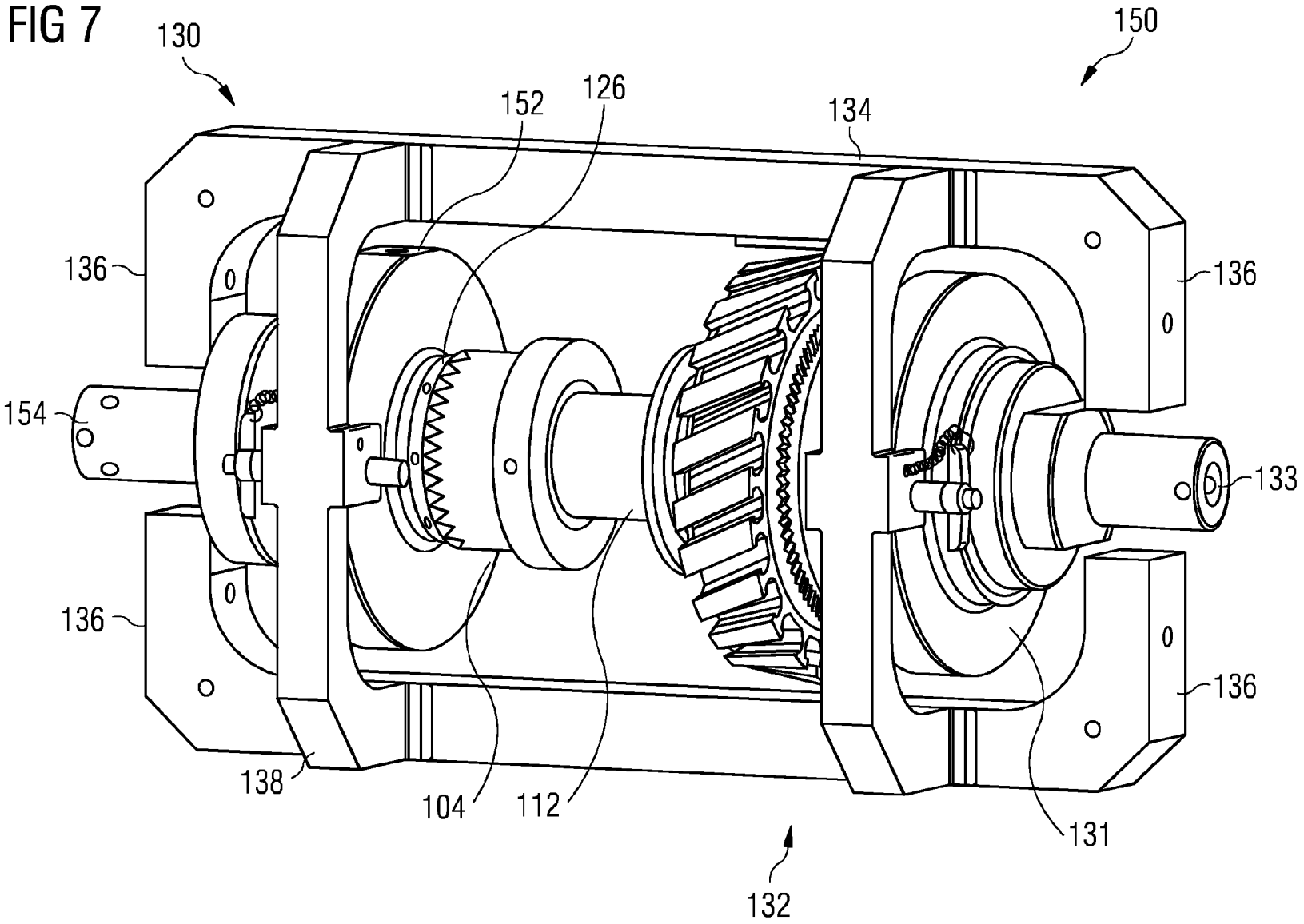
FIG. 7 shows a view of a safety apparatus applied to a second sub-assembly.

FIG. 7 shows an example of the safety apparatus 130 connected to a second sub-assembly 150. FIG. 7 is identical to FIG. 6, but with the compression body 120, the tool head 122 and the actuator 124 removed and replaced with a transport plate 152 and a second machine centre 154. In other words, the second sub-assembly 150 is identical to the first sub-assembly 117, but with the compression body 120, the tool head 122 and the actuator 124 removed and replaced with a transport plate 152 and a second machine centre 154.

In order to replace the compression body 120, the tool head 122 and the actuator 124 with the transport plate 152 and an adjustable machine centre 154, the safety apparatus 130 need to be temporarily disconnected from the sub-assembly 117. This alteration occurs at a higher risk as the safety apparatus 130 will not be able to contain loads or an energy released from a failure of one or more components. As such, this operation should be done as efficiently as possible, such that the safety frame 130 can be reconnected as soon as possible.

As shown in FIG. 7, the transport plate 152 is configured to engage with the inlet shaft 104 via the load retainer 126. In one example, the transport plate 152 includes a bore therethough for receiving the tension stud 102.

In the example shown in FIG. 7, the connecting member 138 is configured to connect to the transport plate 152 of the second sub-assembly 150. The second sub assembly 150 also includes the second machine centre 154, which may be adjustable using a plurality of adjustment screws and a female centre as described above in relation to the first machine centre 133. As shown in FIG. 7, the end of the first machine centre 133 extends past the arm 136 of the containment member 132 in a first direction and the end of the second machine centre 154 extends past the other arm 136 of the containment member 132 in a second direction. This arrangement enables the safety frame 130 and second sub-assembly 150 to be located between machine centres.

When the safety apparatus 130 has been attached to the second sub-assembly 150, the safety apparatus 130 and second sub-assembly 150 may be safely transported by connecting one or more lifting members to the one or more lifting holes 146. The safety apparatus 130 is adapted for transport of the 'ready for machining' sub assembly 150.

Figure 8:
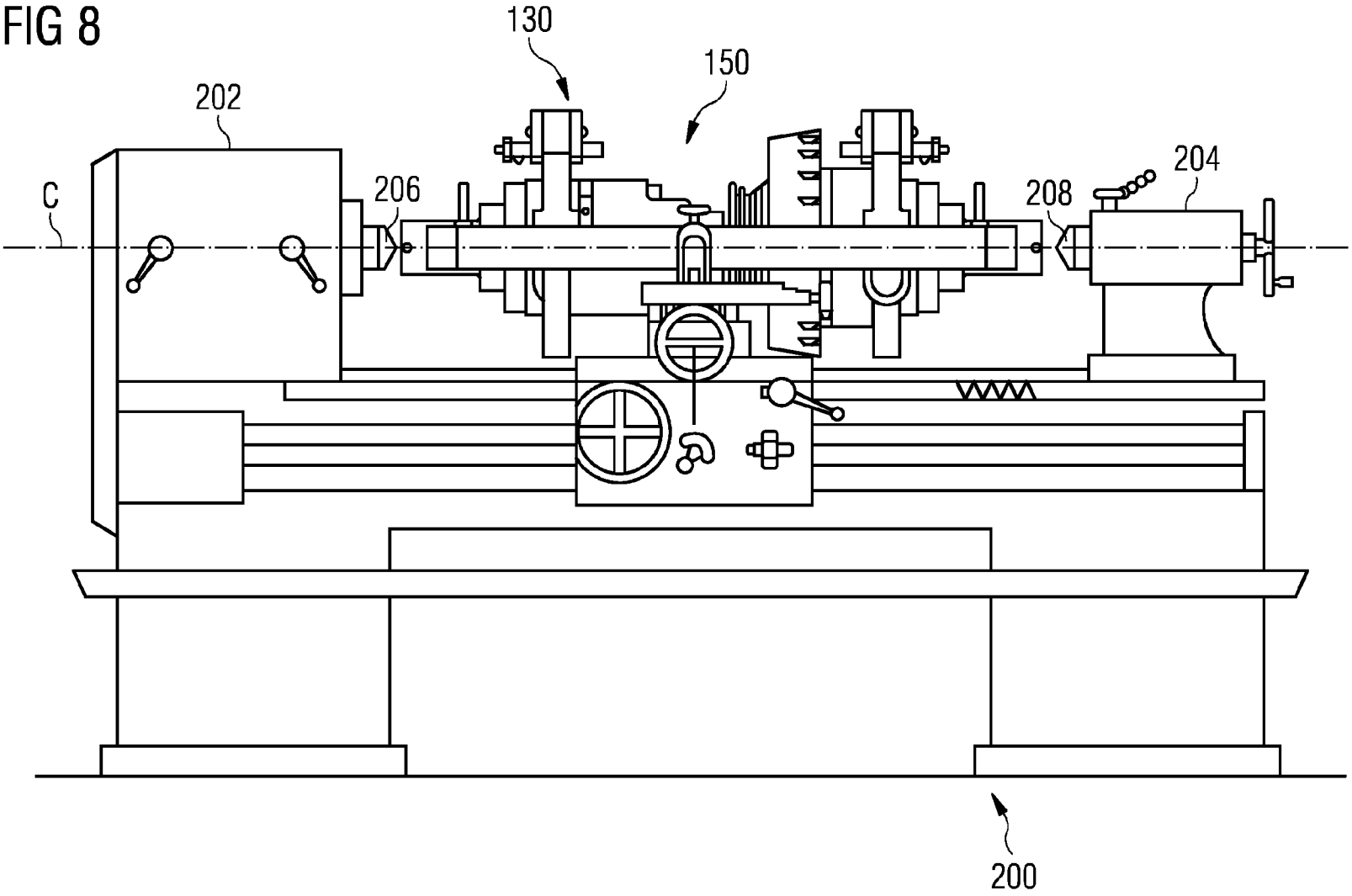
FIG. 8 shows a schematic of a second sub-assembly in a machine.

FIG. 8 shows an example of part of the safety apparatus 130 and second sub-assembly 150 installed in a machine 200 for machining the journal 112. The machine 200 may include a headstock 202 and a tailstock 204. In FIG. 8, the first machine centre 133 of the second sub-assembly 150 is engaged with a dead centre 208 of the machine 200 and the second machine centre 154 of the second sub-assembly 150 is engaged with a live centre 206 of the machine. The axis C indicates the machine centre line.

With the safety apparatus 130 and the second sub-assembly 150 mounted between 'Live' 206 and 'Dead' centres 208, safety apparatus 130 can be removed because any energy release will be contained by the machine 200.

Following the removal of the safety apparatus 130, the journal 112 can be machined so as the remove the bulge due to the barrelling and return the journal to a cylindrical shape. Once the journal 112 has been machined, the safety apparatus 130 can be re-fitted and the second sub-assembly 150 can be transported and/or stored.

To remove the tooling the Hydraulic Cell is used in a reverse procedure to that of journal compression operation described previously, which is also done whist the sub assembly 150 is within the safety apparatus 130.

As such, the safety apparatus 130 performs three functions for improving safety. Firstly, the safety frame 130 enables the compression load to be safely applied to the inlet shaft 104 and the tension stud 102. Secondly, once the load has been applied, the safety frame 130 enables the sub assembly 117, 150 to be safely stored. Thirdly, the safety apparatus 130 enables the sub-assembly 117, 150 to be transported.

In one example, a resilient material, such as rubber, is provided between the arms 136 of the containment member 132 and the components of the tool apparatus 116 and/or rotor assembly 100. For example, resilient material may be provided between the arm 136 and the tool head 122 and also between the arm 136 and the adapter 131.

Figure 9:
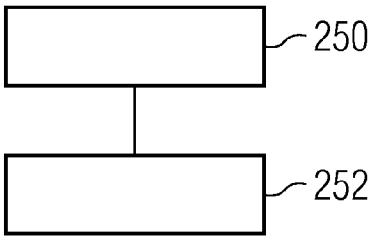
FIG. 9 shows a flow diagram of steps of a method of applying a load to a shaft of a rotor assembly.

FIG. 9 shows an illustration of a method of shaping a journal (112) of a shaft (104) of a rotor sub-assembly (117, 150).

In step 250 a pre-determined compression load is applied to the shaft (104). The pre-determined compression load results in a deformation of the journal (112) to produce a loaded journal (112) with a substantially concave profile, for example, due to barrelling.

In step 252, the loaded journal (112) is shaped to produce a substantially cylindrical loaded journal (112) such that when the pre-determined compression load is removed, the journal (112) has a substantially convex profile.

Figure 10:
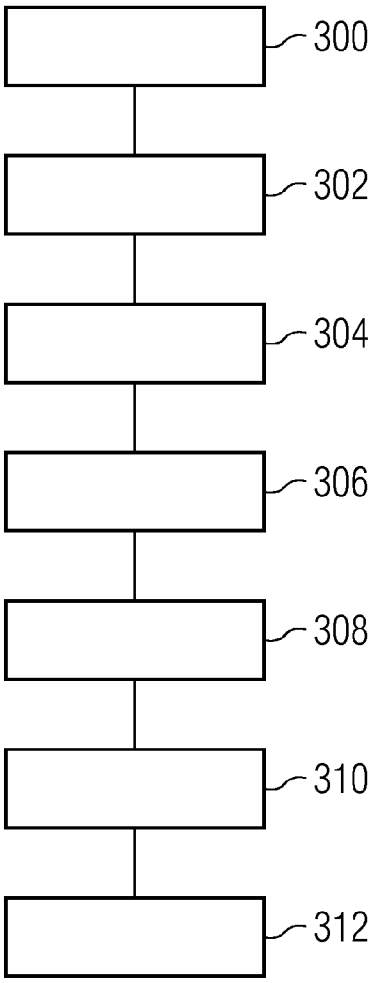
FIG. 10 shows an illustration of a method of applying a pre-determined compression load to a shaft of a rotor assembly.

FIG. 10 shows an illustration of a method of applying a pre-determined compression load to a shaft 104 of a rotor assembly 100. In one example, the load is applied to an inlet shaft 104.

In step 300, the adapter 131 is engaged with a first end of a shaft 104 of the rotor assembly 100. In one example, the shaft comprises an inlet shaft 104.

In step 302, a compression body 120 is engaged with a second end of the shaft 104. The compression body 120 may be sized to ensure a positive engagement between the compression body 120 and the inlet shaft 104.

In step 304, a tool head 122 is engaged with a tension stud 102 extending through the shaft 104. The tool head 122 may extend through a central bore through the inlet shaft 104.

In step 306, an actuator is provided between the compression body 120 and the tool head 122. In one example, the tool head 122 includes a removable insert 128 comprising a hollow cylinder in which both the outside face and the inside face of the hollow cylinder are threaded. The thread on the outer face of the removable insert 128 may connect with a corresponding thread of a cavity within the tool head 122 for receiving the removable insert 128. The thread on the internal face of the removable insert 128 may connect with a corresponding thread on the tension stud 102.

In step 308, the safety apparatus 130 as described above is connected to the compression body 120 and/or the adapter 131. The safety apparatus 130 may include one or more connecting members 138 that are connected to the compression body 120 and/or the adapter 131.

In step 310, the actuator 124 is actuated to provide a load to the compression body 120 and the tool head 122 to cause the tension stud 102 to extend.

In step 312, a load retainer 126 is engaged with the second end of the shaft 104 to retain the load in the compression body 120.

In a further step, the method may include measuring the elongation of the tension stud 102 via measurement apparatus 129. The method may further include determining that the tension stud 102 has elongated by a predetermined amount and rotating the load retainer 126 which is cooperatively threaded to the tension stud 102. The load retainer 126 is moved so that it engages with the shaft 104 of the rotor assembly 100.

Following the application of the load to the inlet shaft 104 and the tension stud 102 and the load retainer 126 has been moved to engage with the inlet shaft 104, the method may further include removing the tool head 122, the actuator 124 and the compression body 120 and providing a transport plate 152 that receives the tension stud 102. In this example, the load retainer 126 is located between the transport plate 152 and the inlet shaft 104.

The method may further include the steps of connecting the safety apparatus 130 to the transport plate 152 and/or the adapter 131.

The method may further include the steps of engaging a first machine centre 133 with the adapter 131 and engaging a second machine centre 154 with the transport plate 152.

The method may further include positioning the first machine centre 133 and the second machine centre 154 between centres of a machine 200, removing the safety apparatus 130 and machining the journal 112 of the shaft 104.

Attention is directed to all papers and documents which are filed concurrently with or previous to this specification in connection with this application and which are open to public inspection with this specification, and the contents of all such papers and documents are incorporated herein by reference.

All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any accompanying claims, abstract and drawings), or to any novel one, or any novel combination, of the steps of any method or process so disclosed.

The invention claimed is:

1. A safety apparatus for containing an energy release from a rotor sub-assembly having a tension stud, the safety apparatus comprising:

a plurality of containment members, wherein each containment member comprises: an elongate region defining a longitudinal axis; and at least two arms projecting away from the longitudinal axis of the elongate region; and at least one connecting member connected to at least two of the plurality of containment members, wherein in use the at least one connecting member is configured to connect the safety apparatus to the sub-assembly and the plurality of containment members are configured to withstand an energy release from the sub-assembly in the event of a failure of one or more components and/or connections of the sub-assembly.

2. The safety apparatus according to claim 1, wherein the plurality of containment members comprises a first containment member and a second containment member having a central axis therebetween, wherein the at least two arms of the first containment member and the at least two arms of the second containment member project towards the central axis.

3. An assembly comprising:

the safety apparatus according to claim 1; and a sub-assembly comprising:

a shaft of a rotor assembly, the shaft comprising a journal;

a tension stud extending through the shaft;

an adapter engaged with a first end of the shaft; and a load retainer configured to engage with a second end of the shaft and receive the tension stud, wherein, in use, the load retainer is configured to move relative to the tension stud and transfer a load from the tension stud to the shaft.

4. The assembly according to claim 3, wherein the adapter is shaped such that a first end of the adapter is configured to engage with a first shaft having a first profile and a second end of the adapter is configured to engage with a second shaft having a second profile, different than the first profile.

5. The assembly according to claim 3, wherein the sub-assembly further comprises:

a compression body engaged with the second end of the shaft;

a tool head engaged with the tension stud; and an actuator located between the compression body and the tool head for applying a load to the tool head and the compression body, wherein the at least one connecting member comprises a first connecting member connected to the compression body and a second connecting member connected to the adapter.

6. The assembly according to claim 5, wherein first connecting member is connected to the compression body via a first quick release pin and the second connecting member is connected to the adapter via a second quick release pin.

7. The assembly according to claim 5, wherein the compression body comprises a protective covering configured to cover at least part of the shaft.

8. The assembly according to claim 3, wherein the sub-assembly further comprises:

a transport plate configured to receive the tension stud, wherein the load retainer is located between the transport plate and the shaft;

wherein the at least one connecting member comprises a first connecting member connected to the transport plate and a second connecting member connected to the adapter.

9. The assembly according to claim 8, further comprising:

a first machine centre configured to engage with the adapter; and a second machine centre configured to engage with the transport plate.

10. The assembly according to claim 5, wherein the tool head comprises a removable insert, the removable insert comprising:

a male thread for engaging with a co-operative female thread of the tool head; and a female thread for engaging with a co-operative male thread of the tension stud.

11. The assembly according to claim 3, further comprising a measurement apparatus configured to measure elongation of the tension stud.

12. A method of shaping a journal of a shaft of a rotor sub-assembly, the method comprising:

applying the safety apparatus of claim 1 to the rotor sub-assembly so the safety apparatus will withstand the energy release from the sub-assembly in the event of the failure;

applying a pre-determined compression load to the shaft, wherein the pre-determined compression load results in a deformation of the journal to produce a loaded journal with a substantially concave profile; and shaping the loaded journal to produce a substantially cylindrical loaded journal, wherein when the pre-determined compression load is removed, the journal has a substantially convex profile.

13. The method according to claim 12, wherein the step of applying the pre-determined compression load to the shaft comprises:

engaging an adapter with a first end of the shaft;

engaging a compression body with a second end of the shaft;

engaging a tool head with a tension stud extending through the shaft;

providing an actuator between the compression body and the tool head;

actuating the actuator to provide a load to the compression body and the tool head to cause the tension stud to extend and the pre-determined compression load to be applied to the shaft; and engaging a load retainer with the second end of the shaft to retain the load in the shaft.

14. The method according to claim 13, further comprising: connecting the safety apparatus to the compression body and/or the adapter prior to actuating the actuator.

15. The method according to claim 14, wherein the step of shaping the loaded journal comprises:

removing the tool head, the actuator and the compression body;

providing a transport plate that receives the tension stud, wherein the load retainer is located between the transport plate and the shaft;

connecting the safety apparatus to the transport plate and/or the adapter;

engaging a first machine centre with the adapter;

engaging a second machine centre with the transport plate;

positioning the first machine centre and the second machine centre between centres of a machine;

removing the safety apparatus; and machining the journal of the shaft.

* * * * *